US006247910B1

(12) United States Patent
Yokoyama

(10) Patent No.: US 6,247,910 B1
(45) Date of Patent: Jun. 19, 2001

(54) SCROLL TYPE COMPRESSOR WHICH REQUIRES NO FLANGE PORTIONS OR HOLES FOR SOLELY POSITIONING PURPOSES

(75) Inventor: Hiroyuki Yokoyama, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/391,492

(22) Filed: Sep. 8, 1999

(30) Foreign Application Priority Data

Sep. 9, 1998 (JP) ..... 10-255436

(51) Int. Cl.[7] ..... F04C 18/04; B23Q 3/18; B23P 15/00

(52) U.S. Cl. ..... 418/55.1; 29/464; 29/888.022

(58) Field of Search ..... 418/55.1; 29/464, 29/888.022

(56) References Cited

U.S. PATENT DOCUMENTS 4,548,556 * 10/1985 Terauchi ..... 29/888.022
4,552,517 * 11/1985 Shimizu ..... 29/888.022
4,608,001 * 8/1986 Sugimoto et al. ..... 29/888.022

FOREIGN PATENT DOCUMENTS 4-112982 * 4/1982 (JP) ..... 29/888.022
12713652 2/1998 (JP) .

* cited by examiner

*Primary Examiner*—John J. Vrablik
(74) *Attorney, Agent, or Firm*—Baker Botts L.L.P.

(57) ABSTRACT

In a scroll type compressor in which a front housing (46) closes an open end of a easing (2) to define a hollow space, a filed scroll member and a movable scroll member are placed in the hollow space. The front housing has a plurality of holes (4*d*) for inserting therethrough bolts. One of the casing and the filed scroll member has a plurality of threaded hole portions (2*d*) and a plurality of non-threaded hole portions (2*f*) extended from extended ends of the threaded hole portions. The threaded hole portions are for engagement with the bolts inserted into the holes of the front housing. The non-threaded hole portions are for receiving end portions of positioning jigs (60) for an alignment of the front housing relative to the casing with a relative angular degree with each other so that at least one pair of the holes of the front housing and the non-threaded hole portions are used for positioning the front housing and the casing.

5 Claims, 5 Drawing Sheets

SCROLL TYPE COMPRESSOR WHICH REQUIRES NO FLANGE PORTIONS OR HOLES FOR SOLELY POSITIONING PURPOSES

BACKGROUND OF THE INVENTION

The present invention relates in general to a scroll type compressor and a method of manufacturing the scroll type compressor more particularly to a scroll type compressor which is assembled by conforming all parts and elements in the assembly procedure and the assembly method thereof.

Such a first conventional scroll type compressor is disclosed In Japanese Patent No. 2,713,652 and is shown in FIG. 5 of the attached drawing. The conventional scroll type compressor has a housing 1 formed by separately assembling each part thereof. The housing 1 has a cup-shaped casing 2, a front case 4 which is coupled with the cup-shaped casing 2 by a bolt 3 and closes one end of the casing 2, and a front cover 6 coupled to the front case 4 by a bolt 5. The front cover 6 has a cylindrical axial hole 6*a* at Its central portion and a rotational shaft 7 which is extended through the axial hole 6*a* is rotatably supported by the housing 1 through bearings 8 and 9.

In a hollow space defined by the housing 1, a fixed scroll member 10 and a movable scroll member 14 are provided. The fixed scroll member 10 has an end plate 11 and an involute wrap 12 which is astended from and provided on an inner surface of the end plate 11. An outer circumferential surface of the and plate 11 is closely contacted with an inner circumferential surface of the casing 2 through a sealing ring 35 to thereby provide a partition for the interior of the housing 1. So that, a discharge cavity 31 is confined on the outer side of the and plate 11, a suction chamber 32 being confined on the inner side of the end plate 11. The fixed scroll member 10 is fixed to the casing 2 by the bolts 13 which are inserted through the holes 33 of a bottom 2*a* of the casing 2 and threadedly engaged with threaded hole 34 of the end plate The movable scroll member 14, on the other hand, has an end plate 15 and an involute wrap 16 which is extended from and provided on the inner surface of the end plate 15. The involute wrap 16 of the movable scroll member 14 is substantially same in configuration as the involute wrap 12 of the fixed scroll member 10.

The movable scroll member 14 and the fixed scroll member 10 are eccentrically offset by a predetermined distance with each other and are offset at 180° and engaged with each other as illustrated in FIG. 5. A tip seal 17 is embedded in a front end portion of the involute wrap 12. The tip seal 17 is closely contacted with the inner surface of the end plate 15. Similarly, a tip seal 18 to embedded in a front end portion of the involute wrap 16. The tip seal 18 is closely contacted with the inner surface of the and plate 11. The side surfaces of the involute wraps 12 and 16 are line-contacted with each other at a plurality of locations on the side surfaces. Thus, a plurality of sealed chambers 19*a* and 19*b* are confined in a point-symmetrical relation relative to a center of the involute curve.

The end plate 15 is provided at its central portion a cylindrical boss 20 in which a bush 21 is rotatably mounted through an orbital bearing 23. The bush 21 is provided with an eccentric hole 24 in which an eccentric pin 25, which is disposed to an inner end of the rotational shaft 7, is rotatably fitted. A balance weight 27 is fixed to the bush 21. A rotation prevention mechanism 26 comprises an Oldham ring and a thrust pad member 36 and to provided between an outer circumferential end of the outer surface of the end plate 15 and the end surface of the front case 4.

When the rotational shaft is driven, the movable scroll member 14 is driven through an orbital driving mechanism consisting of the eccentric pin 25, bush 21, orbital bearing 23, boss 20, and others. In this event, the movable scroll member 14 is subject to an orbital motion with its rotating motion being prevented by the rotation prevention mechanism 26.

By the orbital motion of the movable scroll member 14, an line-contact portion between the two involute wraps 12 and 16 is shifted toward a center of the involute (spiral-shaped) structure of the wraps. Consequently, the sealed small chambers 19*a* and 19*b* are moved toward the center of the Involute with their volume decreasing.

Then, gas is sucked into a suction chamber 32 through a suction port (not shown) and introduced into the sealed small chambers 19*a* and 19*b* through an outer and opening portion relative to the involute wraps 12 and 16 and delivered into the center chamber 22 while it is compressed. Then the compressed gas is fed through a discharge port 29, which is fitted to the end plate 11 of the fixed scroll member 10, to forcibly open a discharge valve 30 and then fed into a discharge cavity 31 and, finally discharged out of the housing 1 through a discharge port (not shown).

The casing 2 has at its open end portion a flange portion 2*c* which has a plurality of threaded holes 2*d* for engagement with bolts 3 and a first positioning hole 53. The front case 4 is provided with a flange portion 4*a* coupled with the flange portion 2*c* of the casing 2. The _flange portion 4*a* of the front case 4 has a plurality of holes 4*d* for receiving bolts 3 and a second positioning hole 54. The second positioning hole 54 can be matched with the first positioning hole 53 only in the case that a relation between the casing 2 and the front case 4 occupies a predetermined relative angle.

In a method of assembly of or manufacturing the scroll type compressor, a front cover 6, the movable scroll member 14, the orbital driving mechanism, the rotation prevention mechanism 26, the thrust pad member 36, and others are mounted to the front casing 4. The movable scroll member 14 and the front case 4 are assembled in a regular relative angle with each other.

The fixed scroll member 10 is inserted into the casing 2 through its one end opening. The casing 2 and the fixed scroll member 10 are coupled together by the bolts 13 so that the casing 2 and the fixed scroll member 10 are coupled together in a regular relative angle with each other.

Then, as shown in FIG. 6, a positioning rod 55 is inserted into the hole 53 of the housing assembly 51 and the hole 54 of the front case assembly 52 so that the holes 53 and 54 are aligned with each other. Then, the flange portion 4*a* of the front case 4 is fitted by means of the bolt 3.

Another conventional scroll type compressor is shown in FIGS. 7 and 8. The casing 2 is coupled with the front housing 46 by means of the bolt 3 which is shown in FIG. 5. Namely, the front housing 46 is a unitary portion consisted with the front case 4 and the front cover 6 shown in FIG. 5.

The front housing 46 is provided, at its outer circumferential portion, with a plurality of flange portions 4*a* an shown in FIG. 5. The flange portion 4*a* is provided with a plurality of holes 4*d* for the bolts 3. The casing 2 is provided at its outer circumferential portion with a plurality of flange portion 2*c* and the flange portion 2*c* has a plurality of threaded hole 2*d* for the bolts 3.

One of the flange portions 2*c* of the opening end of the casing 2 has a hole 53 which constitute a first positioning portion. The flange portion 4*a* of the front housing 46 has the hole 54 as a second positioning portion such that the hole 53 as the first positioning portion is aligned with the hole 54 of the second positioning portion only when the casing 2 on which the fixed scroll member 10 is mounted has a predetermined relative angular degree with respect to the font housing 46 on which movable scroll member 14, orbital motion mechanism, rotation prevention mechanism 26 are mounted.

By inserting the positioning rod 55 into the hole 54 of the front housing 46 and the hole 53 of the casing 2, the holes 53 and 54 are aligned with each other. Then, the flange portion 4*a* of the front housing 46 is coupled with the casing 2 by using the bolts 3.

With reference to FIGS. 9 and 10, the casing 2 and the fixed scroll member 10 are coupled together by engaging the and portion of the bolt 13 with the threaded hole 34 of the end plate 11, the bolt being inserting through holes 33 of the bottom of the casing 2.

In this case, the positioning rods 55, 56 are used for commonly positioning the hole 53 of the casing 2 and the hole 11*a* of the involute wrap 12 of the fixed scroll member 10 so that both the casing 2 and the fixed scroll member 10 are positioned and then the bolts 13 are used to couple the casing 2 and the fixed scroll member 10 together and assembled in a regular relative angular position.

In the conventional scroll type compressors discussed above, a number of holes for positioning purposes are provided in elements and parts thereof such as holes 11*a*, 53, 54, but each of these holes serves no more than positioning function. Therefore, these holes are useless any more after assembly in finished.

Further, in order to provide the positioning holes 11*a*, 53 and 54, the flange portions 2*c* and 4*a* are first provided for these positioning holes and steps for forming these holes are necessary. Consequently, materials for the housing as well as the number of steps for production are increased inevitably.

SUMMARY OF THE INVENTION

It is therefore an object of the present invention to provide a scroll type compressor which requires no flange portions or holes for solely positioning purposes and which can reduce manufacturing steps and production cost.

It is another object of the present invention to provide a method of manufacturing the scroll type compressor described above.

Other objects of the present invention will become clear as the description proceeds.

According to an aspect of the present invention, there is provided a scroll type compressor which comprises a casing having an open and, a front housing closing the open and of the casing to define a hollow space in cooperation with the casing, and a fixed scroll member and a movable scroll member placed in the hollow space. The scroll members both have involute wraps and end plates fixed to axial ends of the involute wraps, respectively. The fixed scroll member is fixed to the casing. The involute wrap of the movable scroll member is inserted into the involute wrap of the fixed scroll member with an offset of a predetermined angular degree. The scroll type compressor further comprises an orbital driving mechanism coupled to the movable scroll member for driving the movable scroll member to have an orbital motion without causing a rotating motion thereof. The front housing has a plurality of holes for inserting therethrough bolts. One of the casing and the fixed scroll member has a plurality of threaded hole portions and a plurality of non-threaded hole portions extended from extended ends of the threaded hole portions. The threaded hole portions are for engagement with the bolts inserted into the holes of the front housing. The non-threaded hole portions are for receiving end portions of positioning jigs for an alignment of the front housing relative to the casing with a relative angular degree with each other so that at least one pair of the holes of the front housing and the non-threaded hole portions are used for positioning the front housing and the casing.

According to another aspect of the present invention, there is provided a method of manufacturing a scroll type compressor which comprises a casing having an open end, a front housing closing the open end of the casing to define a hollow space in cooperation with the casing, and a fixed scroll member and a movable scroll member placed in the hollow space. The both have involute wraps and end plates fixed to axial ends of the involute wraps, respectively. The fixed scroll member is fixed to the casing. The involute wrap of the movable scroll member is inserted into the involute wrap of the fixed scroll member with an offset of a predetermined angular degree. The scroll type compressor further comprises an orbital driving mechanism coupled to the movable scroll member for driving the movable scroll member to have an orbital motion without causing a rotating motion thereof. The front housing has a plurality of holes for inserting therethrough bolts. One of the casing and the fixed scroll member has a plurality of threaded hole portions and a plurality of non-threaded hole portions extended from extended ends of the threaded hole portions. The method comprises the steps of inserting positioning jigs into at lease one pair of the holes of the front housing and the non-threaded hole portions to make an alignment between the casing and the fixed scroll member, inserting the bolts into the holes of the front housing, and engaging the bolts with the threaded hole portions to thereby providing a firm coupling between the casing and the fixed scroll member.

DESCRIPTION OF THE PREFERRED EMBODIMENT

Figure 1:
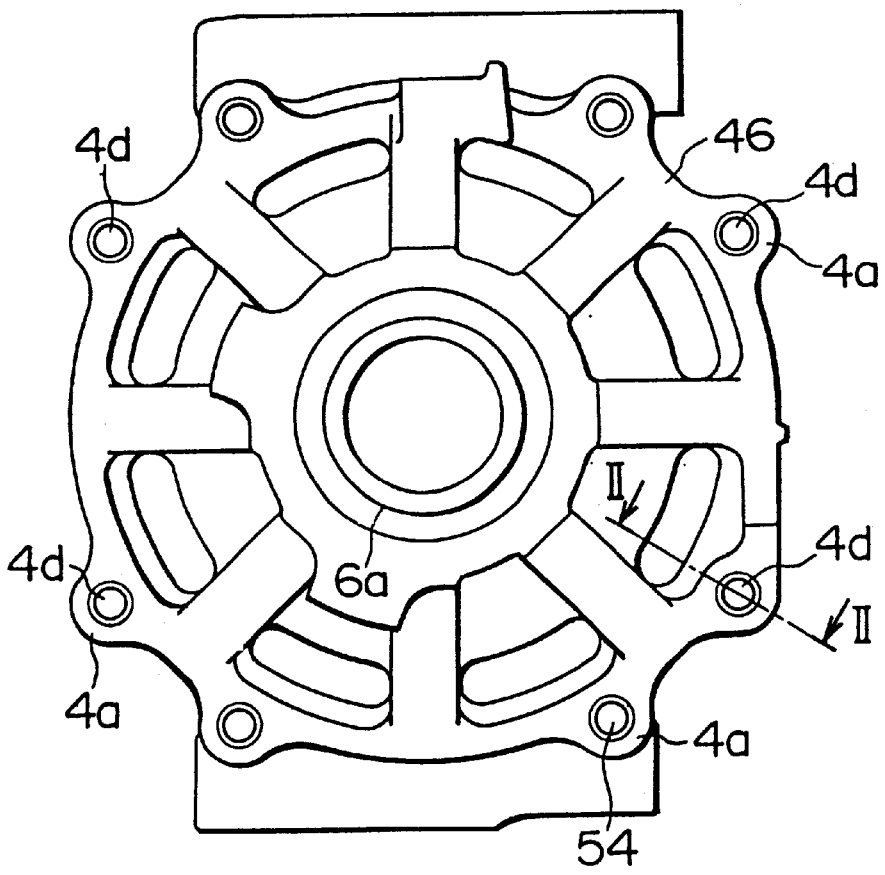
FIG. 1 is a side view of a front housing of a scroll type compressor according to a preferred embodiment of the invention.
Figure 2:
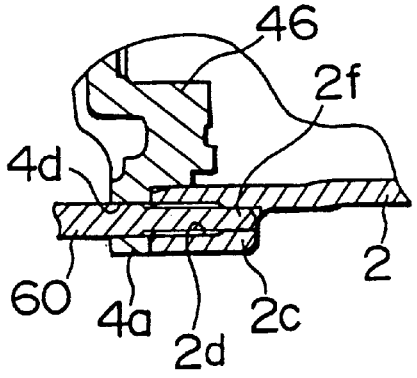
FIG. 2 is a sectional view of the front housing, taken along line II—II of FIG. 1.

With reference to FIGS. 1 and 2, description will be made as regards a scroll type compressor according to an embodiment of the invention.

Figure 5:
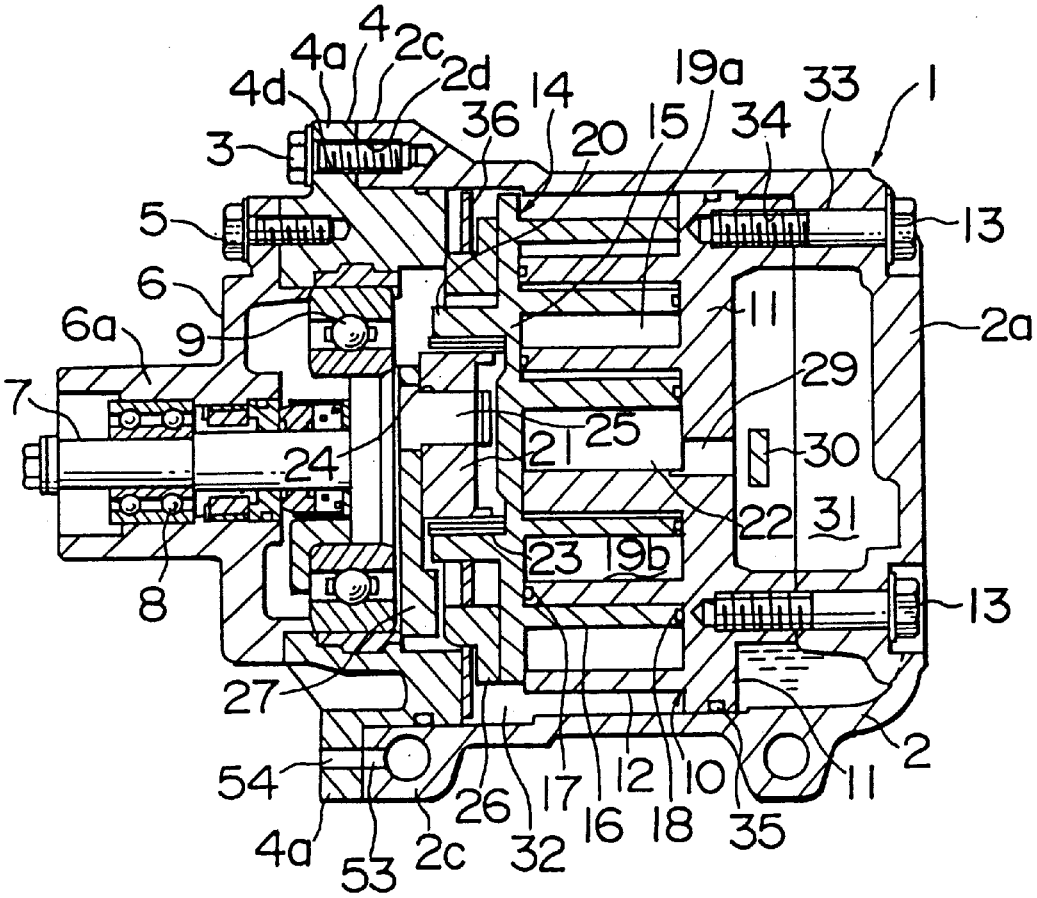
FIG. 5 PRIOR ART
FIG. 5 is a vertical sectional view of a first conventional scroll type compressor.
Figure 6:
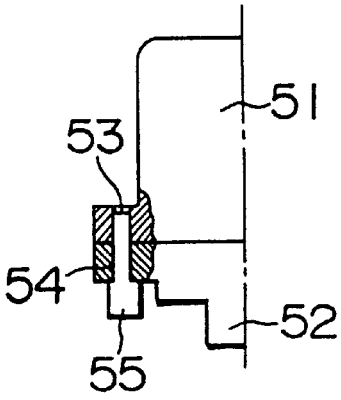
FIG. 6 PRIOR ART
FIG. 6 is a sectional view of a principal portion of the first conventional scroll type compressor, showing an assembly of the compressor.
Figure 7:
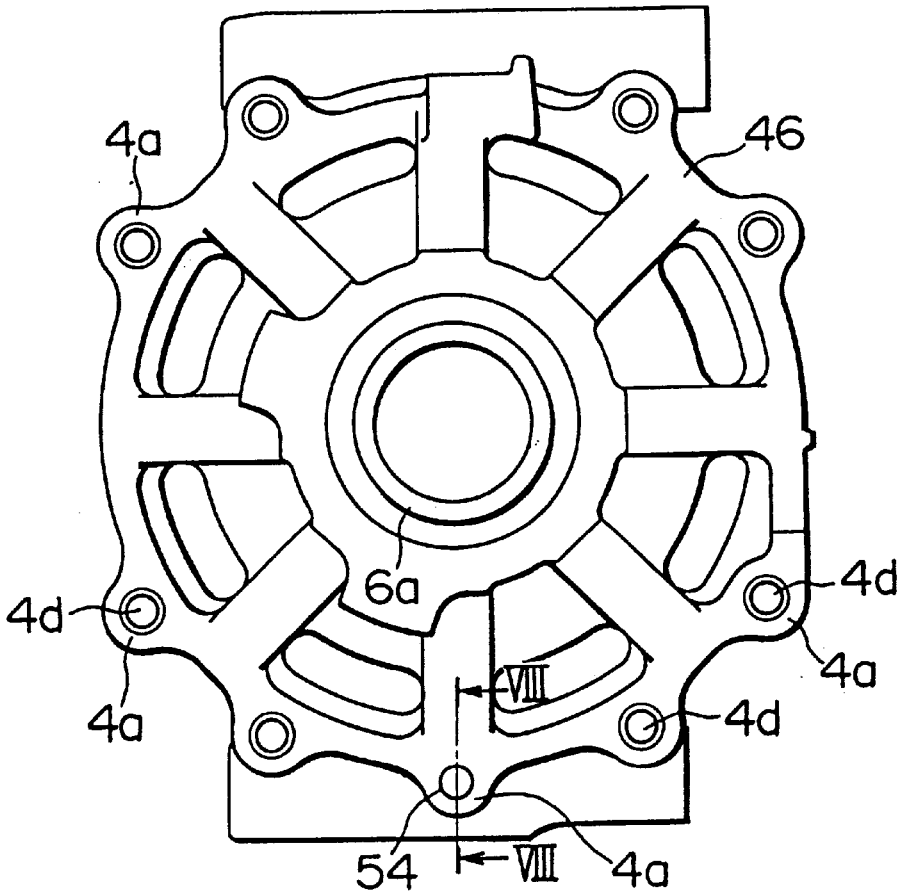
FIG. 7 PRIOR ART
FIG. 7 is a side view of a front housing of a second conventional scroll type compressor, seen from a front housing thereof.
Figure 8:
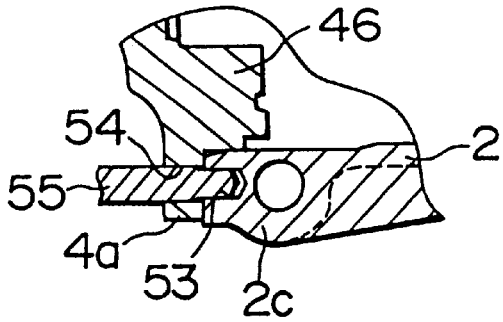
FIG. 8 PRIOR ART
FIG. 8 is a sectional view taken along line VIII—VIII of FIG. 7.
Figure 9:
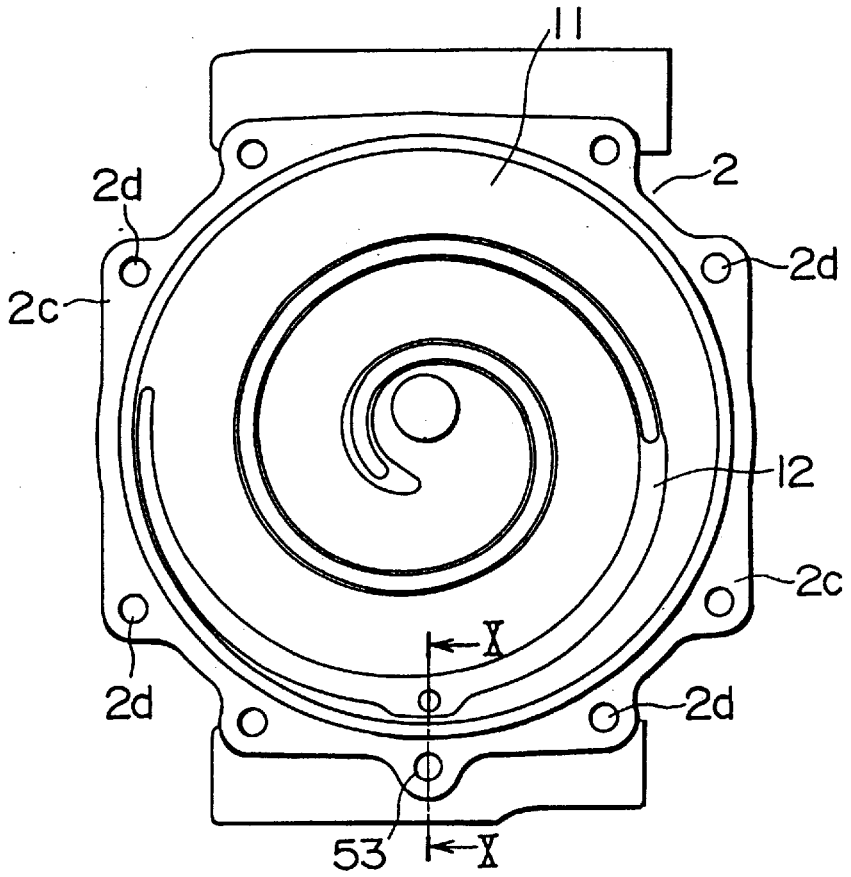
FIG. 9 PRIOR ART
FIG. 9 is a side view of the second conventional scroll type compressor, seen from the fixed scroll member.
Figure 10:
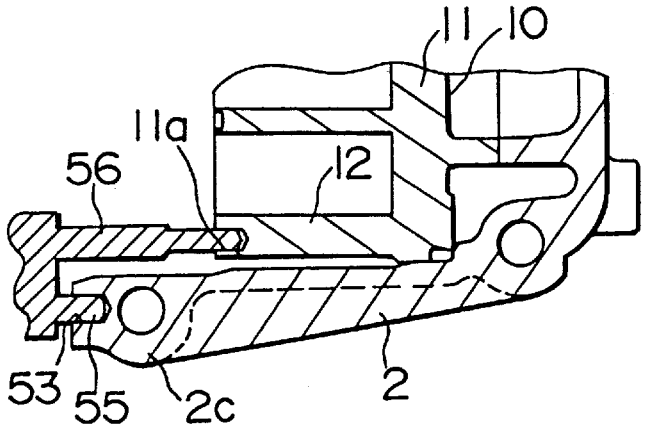
FIG. 10 PRIOR ART
FIG. 10 is a sectional view taken along line X—X of FIG. 9.

The scroll type compressor has a front housing 46 which has a plurality of flange portions 4*a* on the outer circumferential portion thereof. The flange portions 4*a* have a plurality of holes 4*d* for receiving therethrough bolts 3 which are shown in FIG. 5. A casing 2 has a plurality of flange portions 2*c* at the outer circumferential portion thereof and the flange portions 2*c* have a plurality of threaded holes 2*d* for engagement with the bolts 3. In the illustrated embodiment, eight (8) flange portions 4*a* are formed on the outer circumferential portion of the front housing 46 and each of the flange portions 4*a* has a hole 4*d* so that eight holes in all are provided. The threaded holes 2*d* of the casing 2 have female threads for engagement with male threads of the bolts 3, and the threaded holes 2*d* of the casing 2 are provided with tap drill holes 2*f* at an extended portion of the female threads thereof. The threaded holes 2*d* are referred to as threaded hole portions. On the other hand, the tap drill holes 2*f* are non-threaded and may therefore be referred to as non-threaded hole portions.

Figure 3:
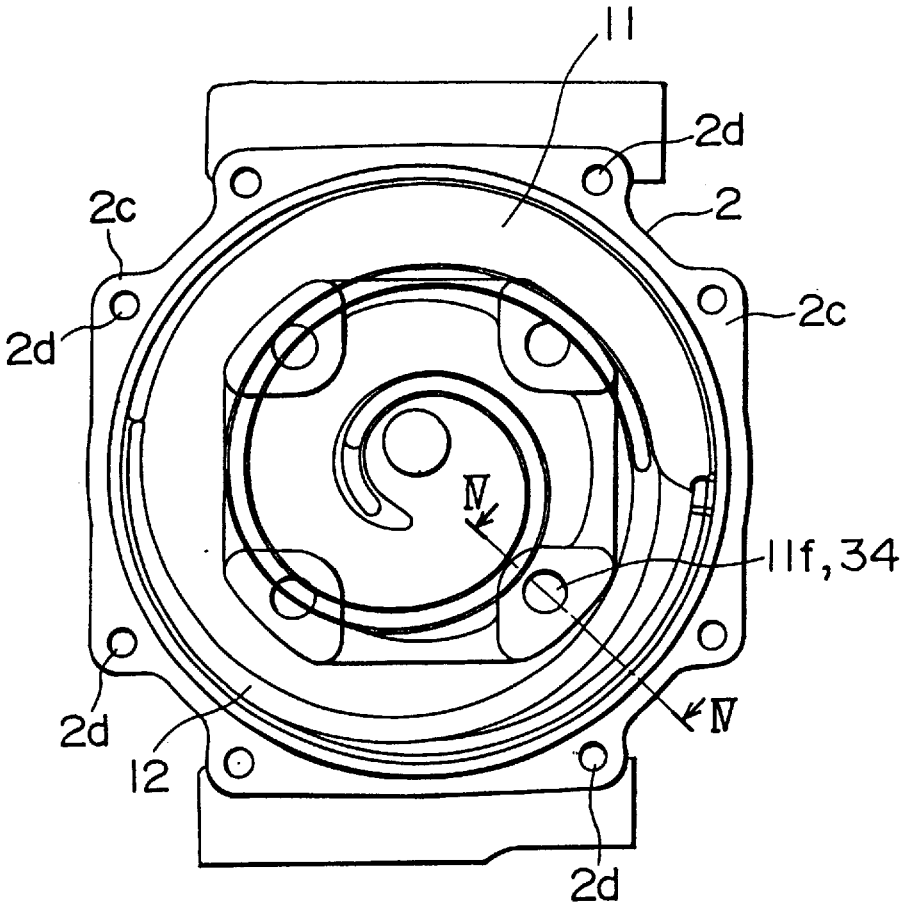
FIG. 3 is a side view of the scroll type compressor, seen from a fixes scroll member, according to an embodiment of the invention.

As illustrated in FIG. 5, the fixes scroll member 10 has an and plate 11 and an involute wrap 12 extending from an inner surface of the end plate 11. An outer circumferential surface of the end plate 11 is closely contacted with an inner circumferential surface of the casing 2 through a sealing ring 35 to partition the interior of the housing 1 so that a discharge cavity 31 is confined on the outside of the end plate 11 and a suction chamber 32 is confined inside the end plate 11. The casing 2 has a plurality of holes 33 at its bottom 2*a* and bolts 13 are inserted through the holes 33 so that the end portions of the bolts 13 are engaged with threaded holes 34 of the end plate 11 so that the fixed scroll member 10 is fixed to the casing 2. At an extended portion of each of the threaded holes 34 is provided an extended hole portion, that is, a tap drill hole 11*f* as well illustrated in FIGS. 3 and 4.

Figure 4:
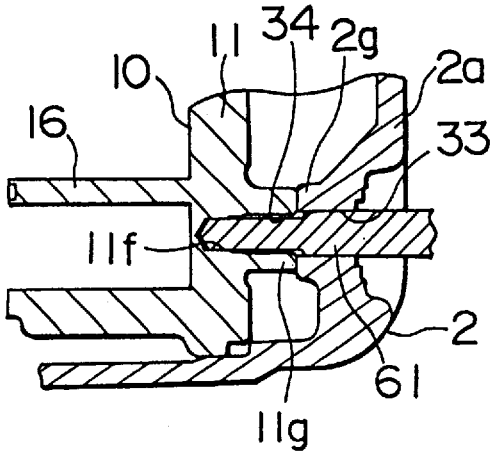
FIG. 4 is a sectional view of the front housing, taken along line IV—IV of FIG. 3.

The fixed scroll member 10 has a projection portion llg which extends from the and plate 11 toward the bottom 2*a* of the casing 2. The bottom 2*a* of the casing 2 has a bottom projection portion 2*g* extending against, in an abutting relation with, an and of the projection portion 11*g* as illustrated in FIG. 4. The threaded hole 34 and the tap drill hole 11*f* are extending from the projection portion 11*g* to the and plate 11, and the hole 33 are provided at the bottom projection portion 2*g*.

A method of assembly of the scroll type compressor according to the present invention will be described with reference to FIGS. 1 to 4. The movable scroll member 14 and the front housing 46 are assembled in a regular configuration with a relative angular degrees with each other by building in the front housing 46, and the elements shown in FIG. 5 such as the movable scroll member 14, the orbital driving mechanism 7, 8, 21, 23, 24, 25, the rotation prevention mechanism 26, the thrust pad member 36, and others.

In the first step, with reference to the hole 33 of the bottom 2*a* of the casing 2 and the threaded hole 34 of the fixed scroll member 10, a positioning jig 61 such as a positioning pin is inserted deep into the tap drill hole 11*f* as illustrated in FIG. 4 so that the casing 2 is aligned with the fixed scroll member 10.

Then, the bolts 13 are used to firmly fixing the casing 2 and the fixed scroll member 10 together. This will permit the assembly of the fixed scroll member and the casing 2 in a regular, relative angular relation with each other.

In case that the bolts 13 are used to fix casing 2 with the fixed scroll member 10 as described, the bolts 13 are inserted into, for threaded engagement with, the threaded holes 34 of the fixed scroll member 10, after the positioning jig 61 is pulled back.

Then, with reference to the hole 4*d* of the front housing 46 and the threaded hole 2*d* of the casing 2, the positioning jig 60 is inserted into the tap drill hole 2*f* so that the hole 4*d* is placed into an alignment relation with the threaded hole 2*d*, as shown in FIG. 2. After that, the bolt 3 is used to firmly fix the flange portion 4*a* of the front housing 46 to the flange portion 2*a* of the casing 2 so that these elements are fixed together.

According to the scroll type compressor, the tap drill hole 2*f* of the threaded hole 2*d* in the fixed scroll member 10 and the hole of the casing 2 are used to proceed positioning of the casing 2 and the fixed scroll member 10 by the positioning jig as described and, therefore, the casing and the fixed scroll member do not require any special holes for the purpose of positioning.

Further, since the tap drill hole 2*f* of the casing 2 and the hole 4*d* of the front housing 46 are used, in combination with the use of the positioning jig 60, to proceed positioning of the front housing 46 and the casing 2, no special holes for positioning are required to the casing and the front housing.

Therefore, it is not necessary to provide flanges and holes for the sole purpose of positioning and, therefore, the process steps can be reduced with the result of reduction of cost for manufacturing and assembly of the scroll type compressor.

Further, the housing has no flange or hole for positioning purposes and, accordingly, a degree of freedom for appearance of the apparatus is improved.

What is claimed is:

1. A scroll type compressor comprising:

a casing having an open end;

a front housing closing said open end of the casing to define a hollow space in cooperation with said casing;

a fixed scroll member and a movable scroll member placed in said hollow space, the both having involute wraps and end plates fixed to an axial ends of said involute wraps, respectively, said fixed scroll member being fixed to said casing, said involute wrap of the movable scroll member being inserted into said involute wrap of the fixed scroll member with an offset of a predetermined angular degree; and an orbital driving mechanism coupled to said movable scroll member for driving said movable scroll member to having an orbital motion without causing a rotating motion thereof;

said front housing having a plurality of holes for inserting therethrough bolts;

said casing having a plurality of threaded hole portions and a plurality of non-threaded hole portions extended from extended ends of said threaded hole portions, said threaded hole portions being for engagement with the bolts inserted into said holes of the front housing, said non-threaded hole portions being for receiving end portions of positioning jigs for an alignment of said front housing relative to said casing with a relative angular degree with each other so that at least one pair of said holes of the front housing and said non-threaded hole portions is used for positioning said front housing and said casing.

2. A scroll type compressor comprising:

casing having an open end;

a front housing closing said open end of the casing to define a hollow space in cooperation with said casing;

a fixed scroll member and a movable scroll member placed in said hollow space, both having involute wraps and end plates fixed to axial ends of said involute wraps, respectively, said fixed scroll member being fixed to said casing, said involute wrap of the movable scroll member being inserted into said involute wrap of the fixed scroll member with an offset of a predetermined angular degree; and an orbital driving mechanism coupled to said movable scroll member for driving said movable scroll member to having an orbital motion without causing a rotating motion thereof;

said casing having a plurality of holes for inserting therethrough bolts;

said fixed scroll ember having a plurality of threaded hole portions and a plurality of non-threaded hole portions extended from extended ends of said threaded hole portions, said threaded hole portions being for engagement with the bolts inserted into the holes of the casing, said non-threaded hole portions being for receiving end portions of scroll positioning jigs for an alignment of the fixed scroll member relative to the casing with a relative angular degree with each other, so that at least one pair of said holes of said casing and said non-threaded hole portions of said fixed scroll member is used for positioning said fixed scroll member and said casing.

3. A method of manufacturing a scroll type compressor comprising:

a casing having an open end;

a front housing closing the open end of the casing to define a hollow space in cooperation with the casing;

a fixed scroll member and a movable scroll member placed in said hollow space, both having involute wraps and end plates fixed to axial ends of said involute wraps, respectively, said fixed scroll member being fixed to said casing, said involute wrap of the movable scroll member being inserted into said involute wrap of the fixed scroll member with an offset of a predetermined angular degree; and an orbital driving mechanism coupled to said movable scroll member for driving said movable scroll member to have an orbital motion without causing a rotating motion thereof;

said front housing having a plurality of holes for inserting therethrough bolts;

said casing having a plurality of threaded hole portions and a plurality of non-threaded hole portions attended from extended ends of said threaded hole portions;

said method comprises the steps of:

inserting a positioning jig into at least one pair of said holes of the front housing and said non-threaded hole portions of said casing to make an alignment between said casing and said front housing;

inserting the bolts into said boles of the front housing; and engaging tee bolts with said threaded hole portions of said casing thereby providing a firm coupling between said casing and said front housing.

4. A method of manufacturing a scroll type compressor comprising:

a casing having an open end;

a front housing closing said open end of the casing to define a hollow space in cooperation with said casing;

a fixed scroll member and a movable scroll member placed in said hollow space, both having involute wraps and end plates fixed to axial ends of said involute wraps, respectively, wherein said involute wrap of the movable scroll member is inserted into said involute wrap of the fixed scroll member with an offset of a predetermined angular degree; and an orbital driving mechanism coupled to said movable scroll member for driving said movable scroll member to have an orbital motion without causing a rotating motion thereof;

said casing having a plurality of boles for inserting therethrough bolts;

said fixed scroll mm having a plurality of threaded hole portions and a plurality of non-threaded hole portions extended from extended ends of said threaded hole portions;

said method comprises the steps of:

inserting a scroll positioning jig into at least one pair of said holes of the casing and said non-threaded hole portions of said fixed scroll member to make an alignment between said casing and said fixed scroll member;

removing the scroll positioning jig from said non-threaded hole portions of said fixed scroll member;

inserting the bolts into said holes of the casing; and engaging the bolts with the threaded hole portions of the fixed scroll member thereby providing a firm coupling between the casing and the fixed scroll member.

5. The method of claim 4, wherein said front housing has a plurality of holes for inserting therethrough bolts; said casing having a plurality of threaded hole portions and a plurality of non-threaded hole portions extended from extended ends of said threaded hole portions; and the method further comprises the steps of:

inserting a positioning jig into at least one pair of said holes of the front housing and said non-threaded hole portions of said casing, to make an alignment between said casing and said front housing;

inserting the bolts through the holes of the front housing; and engaging the bolts with the threaded hole portions of the casing thereby providing a firm coupling between the casing and the front housing.

* * * * *